US005908244A

United States Patent [19]

Galambos

[11] Patent Number: 5,908,244

[45] Date of Patent: Jun. 1, 1999

[54] PLASTIC FILM BAG WITH LOCKING CLOSURE FEATURE

[76] Inventor: Louis G. Galambos, 504 Bay Cir., Indian Harbour Beach, Fla. 32937

[21] Appl. No.: 09/035,120

[22] Filed: Mar. 5, 1998

[51] Int. Cl.[6] ..... B65D 33/10

[52] U.S. Cl. ..... 383/8; 383/77

[58] Field of Search ..... 383/8, 77, 70, 383/71

[56] References Cited

U.S. PATENT DOCUMENTS

| | | | |
|---|---|---|---|
| 3,642,189 | 2/1972 | Widenback . | |
| 3,774,838 | 11/1973 | Christie | 383/77 |
| 4,811,417 | 3/1989 | Prince et al. | 383/8 X |
| 5,056,931 | 10/1991 | Williams . | |
| 5,335,788 | 8/1994 | Beasley . | |
| 5,568,979 | 10/1996 | Fifer . | |

FOREIGN PATENT DOCUMENTS

| | | | |
|---|---|---|---|
| 1496589 | 9/1967 | France | 383/8 |
| 2490190 | 3/1982 | France | 383/77 |
| 3829056 | 11/1989 | Germany | 383/8 |
| 1150037 | 4/1969 | United Kingdom | 383/77 |

*Primary Examiner*—Jes F. Pascua
*Attorney, Agent, or Firm*—Alvin S. Blum

[57] ABSTRACT

A flaccid plastic film bag has opposed handle portions. Each handle has side elements upstanding from the bag body on either side of a hand-receiving aperture. Slits are provided in the edges of the side elements. The slits originate inward of the edge and extend downward and outward to cut through the edge. When one handle is passed through the aperture of the other handle to close the mouth of the bag, the slitted edges prevent the handles from slipping apart and spilling the contents of a loaded bag during transport.

8 Claims, 1 Drawing Sheet

PLASTIC FILM BAG WITH LOCKING CLOSURE FEATURE

BACKGROUND OF THE INVENTION

This invention relates to handled thermoplastic film bags and more particularly to bags of the T-shirt type in which means are provided for maintaining the top opening closed after the bag has been loaded.

Plastic film bags, because of their many advantages, have largely replaced paper bags in many retail stores, especially groceries. These bags generally have laterally spaced handles extending upwardly from opposed sides of an open mouth. Because the film material is so thin and flaccid, the bag will not stand open as would a paper bag. It is held open and suspended from a holder during loading.

A serious disadvantage of this type of bag is related to the flaccid nature of its structure. When the loaded bag is set down in the trunk or on the seat of a vehicle, it often tips over, spilling the contents. This can be overcome by knotting the two handles together. However, this is labor intensive and the knot is not easily untied. Various closure locking means are discussed and reviewed in U.S. Pat. No. 5,568,979 issued Oct. 29, 1996 to Fifer et al. They all add to the cost of the bag, making their acceptance difficult. A plastic film bag of this type that would lock in the closed position without excessive effort and that would be easy to unlock would be very useful. If it could be provided with such a locking feature without significant additional cost, then it would be more likely to gain acceptance in the industry.

SUMMARY OF THE INVENTION

It is, accordingly, an object of the invention to provide a plastic film bag that preserves all of the advantages of current bags and additionally provides means for readily and reversibly closing off the mouth of the bag to prevent spilling of the contents. It is another object of the invention that the improvement in locking closed the bag mouth not add significant cost.

The locking feature of bags of the invention comprises slits cut in the edges of the upwardly directed handle portions of the bag. These slits begin inward of the edge and extend downward and outward to the edge, actually cutting through the edge. When the mouth of the bag is closed by drawing the opposed handle portions together, one handle is passed through the other handle aperture at least once or looped around and passed through again. The edge that has been interrupted by one or more slits prevents the handles from sliding freely apart, thus keeping the mouth of the bag locked in the closed condition. The handles are easily released from the locked position because there is no knot to untie. There is negligible additional cost to this feature, since the cutting die that cuts the bag easily includes blades that cut the slits with no additional operations required.

These and other objects, advantages and features of the invention will become more apparent when the detailed description is studied in conjunction with the drawings, in which like reference characters designate like elements in the various drawing figures.

DETAILED DESCRIPTION OF PREFERRED EMBODIMENTS

Figure 4:
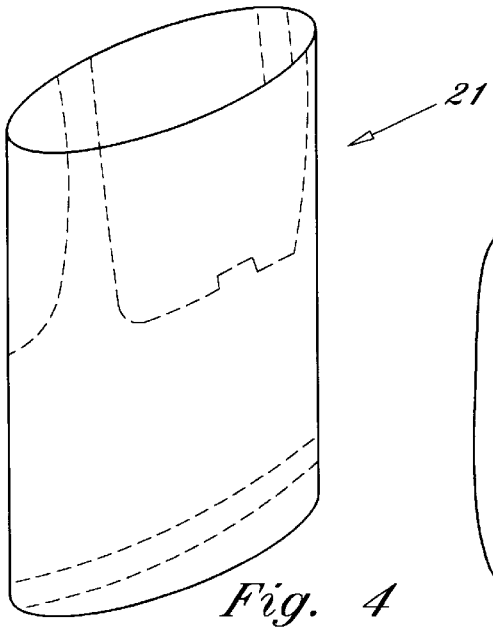
FIG. 4 is a perspective view of a film tube prior to bag fabrication.

Referring now first to FIG. 4, the bag of the invention is preferably formed in the conventional manner from a very thin (less than one mil) blown flaccid film tube 21 of polyethylene or other suitable plastic as described, for example, in U.S. Pat. No. 5,335,788 issued Aug. 9, 1994 to Beasley et al.

Figure 1:
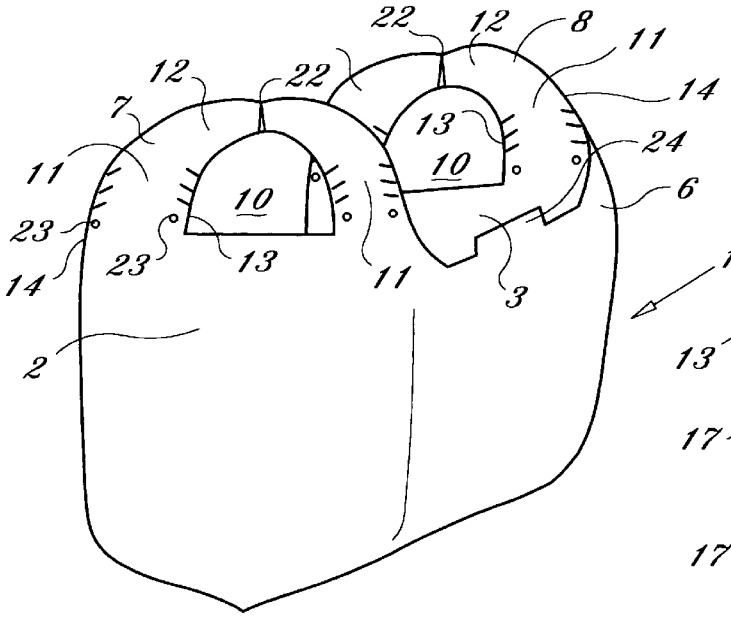
FIG. 1 is a perspective view of a bag of the invention.
Figure 2:
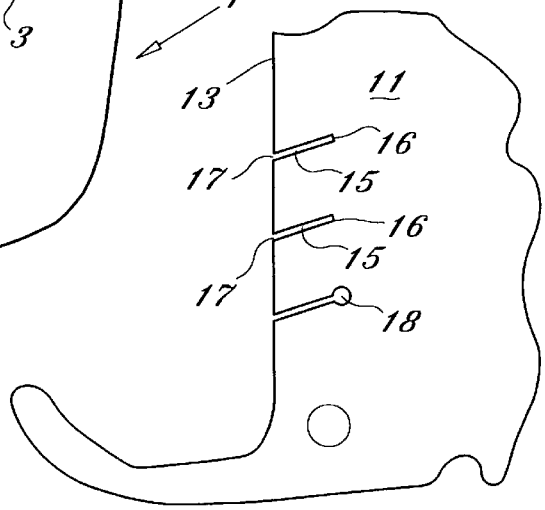
FIG. 2 is an enlarged detail of an edge of a handle portion of the bag of FIG. 1.
Figure 3:
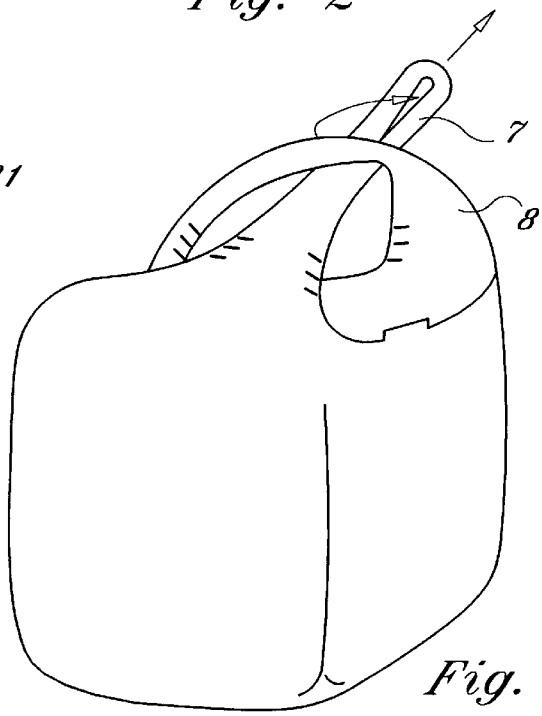
FIG. 3 is a perspective view of the bag in closed condition.

Referring now to FIGS. 1–3, the bag 1 of the invention has a front film wall 2 and an opposed rear film wall 3 integrally joined together at their sides 4, by virtue of being formed from a tube. The bottoms of the walls are welded together to form closed bottom 5 of the bag. The joined walls 2, 3 and sealed bottom comprise a bag body 6. Upstanding from the bag body 6 are laterally opposed handle portions 7, 8. Each handle portion includes a hand-receiving aperture 10, side elements 11 upstanding from body 6 that are connected at their upper ends by top handle member 12. In the process of die cutting and welding the tube, welded seam 22 helps to form the handle portion.

Each side element 11 has an inner edge 13 adjacent the aperture 10 and an outer edge 14. The bag may also be provided with holes 23 for holding a stack of closed bags on a rack. When a tab 24 is pulled, the wall 2 is pulled away from wall 3 opening the mouth 9 for loading while the bag is supported on the rack (not shown). All of the above is conventional and well known in the art.

The problem with bags of the prior art arises when the filled bag is pulled from the rack by the handles and deposited on a moving surface such as the seat or trunk of a vehicle. When not supported by the handle portion, the filled, flaccid bag is easily capsized, spilling the contents.

The bag of the invention has solved the problem by the very simple expedient of slits 15 cut in the inner edges 13 and/or the outer edges 14 of the side elements 11. These slits 15 have an origin 16 inward of the edge, extending downward and outward to divide the edge at 17. The origin 16 may be the simple end of a straight cut or may be a circular punched out area 18.

As best seen in FIG. 3, when a first handle portion 7 is passed through the aperture of a second handle portion 8 to close the mouth of the bag, the handles, which would ordinarily slip easily apart in bags of the prior art, are held together and prevented from easily slipping apart by the interaction of the rough edges caused by the slits.

The plastic film is inherently lubricous, but the downwardly directed cut edges produced by the slits tend to catch on the other handle and inhibit the free sliding of one plastic surface against the other.

The handle 7 may be looped around and passed a second time through the aperture of handle 8. Alternatively, the handle 8 may be passed through the aperture of handle 7 after the first closure.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention.

What is claimed is:

1. A handled flaccid film bag with locking closure feature, the bag comprising:

(A) front and rear flaccid film walls integrally joined together at their sides and sealed together at their bottoms to form a bag body with a closed bottom;

(B) laterally opposed handle portions extending upwardly from the bag body and defining an open mouth portion therebetween;

(C) each handle portion having a hand-receiving aperture defining two side elements upstanding from the bag body and connected at their upper ends to a top handle member, each side element having an inner edge adjacent the aperture and an outer edge; and (D) at least one slit means in at least one of the inner edge and the outer edge of at least one of the side elements for releasably maintaining the mouth of the bag closed when one handle portion is pulled through the aperture of another handle portion at least once, the slit means having an origin inward of the edge and extending downwardly and outwardly to the edge so as to divide the edge.

2. The bag according to claim 1, in which the origin has a substantially circular configuration.

3. The bag according to claim 2, in which the entire bag is formed from a tubular thermoplastic film.

4. The bag according to claim 1, in which the entire bag is formed from a tubular thermoplastic film.

5. The bag according to claim 4, in which there are a plurality of slit means.

6. The bag according to claim 3, in which there are a plurality of slit means.

7. The bag according to claim 2, in which there are a plurality of slit means.

8. The bag according to claim 1, in which there are a plurality of slit means.

* * * * *